United States Patent [19]

Wiles et al.

[11] Patent Number: 4,669,624

[45] Date of Patent: Jun. 2, 1987

[54] MEANS FOR MOUNTING AND LOCKING A SCREW THREADED CLOSURE IN A PREDETERMINED POSITION

[75] Inventors: Laurence E. Wiles, Cheshire; Frank C. Page, III, Watertown, both of Conn.

[73] Assignee: Specialty Packaging Products, Inc., Bridgeport, Conn.

[21] Appl. No.: 789,413

[22] Filed: Oct. 21, 1985

[51] Int. Cl.[4] ..... B65D 41/04

[52] U.S. Cl. ..... 215/330

[58] Field of Search ..... 215/330, 331, 217

[56] References Cited

U.S. PATENT DOCUMENTS 3,620,400 11/1971 Braun ..... 215/330

4,519,518 5/1985 Wiles et al. ..... 215/331

*Primary Examiner*—Donald F. Norton

[57] ABSTRACT

A container with an externally threaded neck portion is adapted to be closed with a closure having an internally threaded sidewall engaging the threads of the neck portion. The threads of the neck portion have at least a lower stop disposed at the inner end of the thread. The threads on the container neck are divided; the threads have a maximum pitch of 8 degrees. The stop on the thread on the neck portion and a stop on one part of the divided thread on the closure insure that the closure is stopped at a predetermined position relative to the container after full-threaded rotation of the closure onto the threaded neck portion has been carried out. The threads on the closure are divided by symmetrically disposed gaps. An anti-rotational stop is provided forcibly to retain the closure in its final, fully applied position while permitting the closure to be removed by the application of an initial relatively high torque. The anti-rotational stop is formed in part by a ramp in the root of the thread on the container neck, and in part by the leading end of a land of a part of the divided thread on the closure.

4 Claims, 5 Drawing Figures

MEANS FOR MOUNTING AND LOCKING A SCREW THREADED CLOSURE IN A PREDETERMINED POSITION

This application is related to application Ser. No. 615,937, filed May 31, 1984, now U.S. Pat. No. 4,519,518, dated May 28, 1985.

BACKGROUND OF THE INVENTION

Many closures have been suggested in recent years because of intense development directed toward insuring that dangerous and poisonous materials be packaged in containers without endangering unqualified persons who may open such containers, for example, small children.

Closures have also been suggested for packaging innocuous material, in which the closure is mounted on the container in a predetermined position, preferably in the position wherein an indicium on the closure is aligned with an indicium on the container. Such a feature constitutes an important advantage in the plastic container state of the art for aesthetic reasons because such alignment makes for a much more attractive appearance of the closed container. Such a closure is, for example, disclosed and described in U.S. Pat. No. 4,387,817. However, such a closure is primarily designed to be child-resistant and has only as a secondary design feature the ability to have the closure aligned with the container. Moreover, the means for aligning the closure with the container in the aforesaid state of the art includes a plurality of thread segments which are disposed on the neck of the closure each one of which must have an arrow-head portion. These arrow-head portions interlockingly engage in gaps formed on a mating thread in the closure. When such engagement between arrow head and gap occurs, the closure is mounted in its predetermined position on the neck of the container. This type of closure also requires a pressing down force before the closure can be unscrewed.

However, it has been found that such a means of mounting a closure on a container neck is not reliable for locking the closure on the container neck because such means are mechanically weak and a person threadedly mounting the closure on the container frequently moves the closure past the stops formed by the arrowhead thereby "stripping" the threads of the closure.

The present invention adds to the double-stop bottle neck of the parent application Ser. No. 615,937 a new anti-rotational stop which prevents any unwanted back-off of the oriented, fully applied closure.

SUMMARY OF THE INVENTION

It is a general object of this invention to improve the means for positioning a closure on the neck of a container in a predetermined fully applied position relative to the container disclosed and claimed in the parent application by the addition thereto of a new anti-rotational stop which prevents any unwanted back-off of the closure while still retaining all of the advantages of the closure disclosed and claimed in the parent application.

It is another, more specific object of this invention to provide an anti-rotational stop to position the closure in a predetermined position in closing the container, the anti-rotational stop forcibly retaining the closure in such final position while making it possible for the user easily to remove the closure when opening the container.

BRIEF DESCRIPTION OF THE DRAWINGS

These and other features contributing to satisfaction and use, as well as the economy of manufacture will be more fully understood from the following description of a preferred embodiment of the invention when taken in conjunction with the accompanying drawings, wherein identical numerals refer to identical parts and in which.

DESCRIPTION OF THE PREFERRED EMBODIMENT

Figure 1:
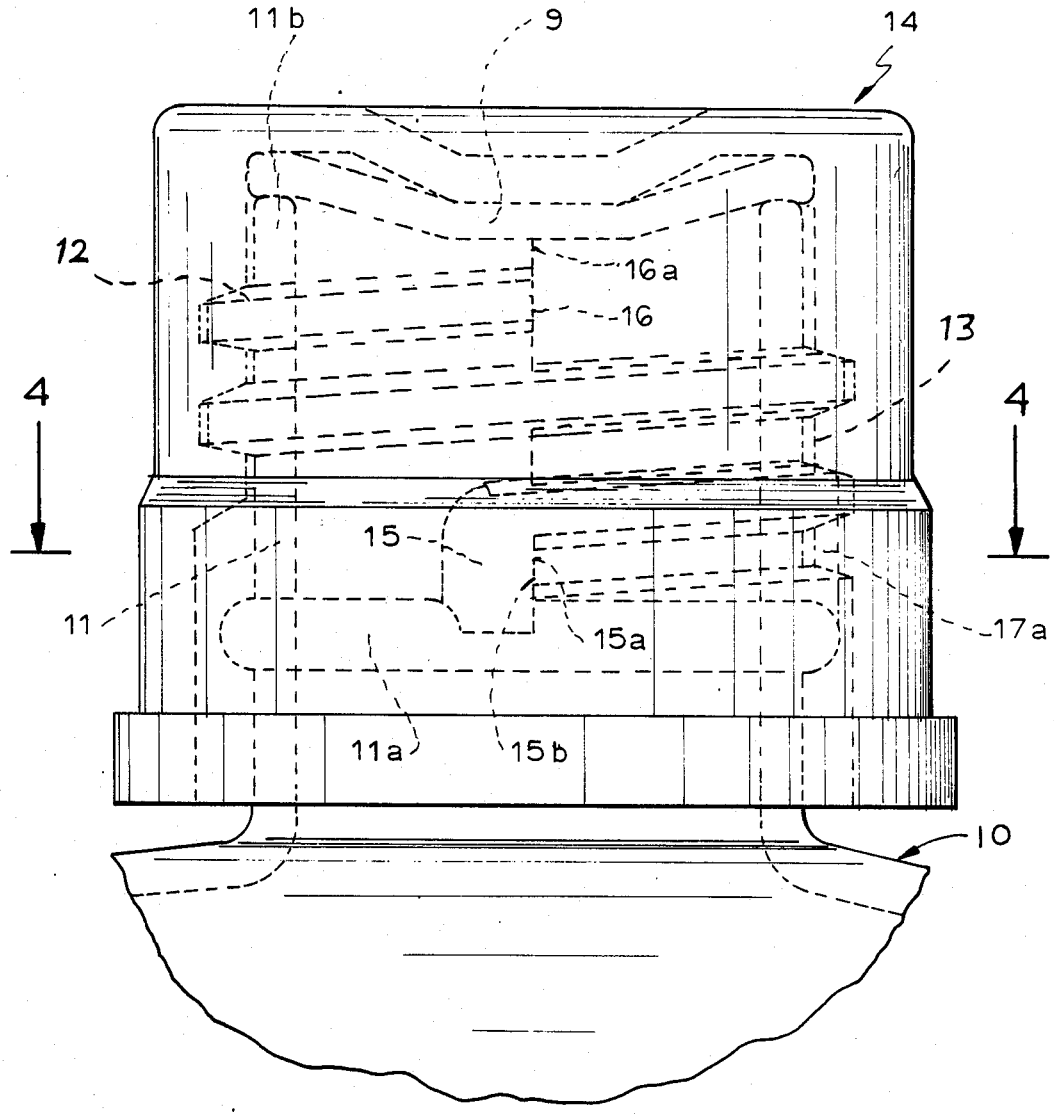
FIG. 1 is side elevational view of the combination of the neck portion of a container and a closure or cap therefor in accordance with the invention, the closure being shown mounted on the neck portion.
Figure 2:
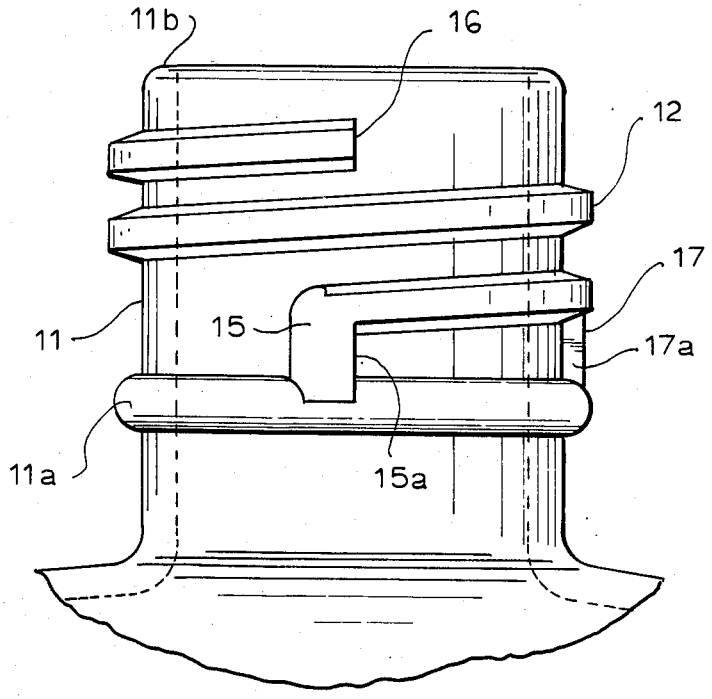
FIG. 2 is a view in side elevation of the neck portion of the container positioned as in FIG. 1.
Figure 3:
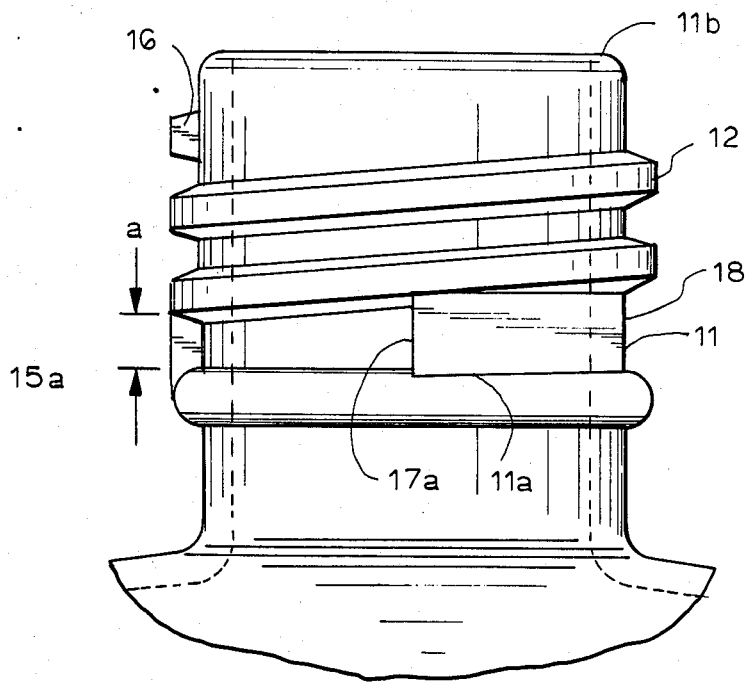
FIG. 3 is a view in side elevation of the neck portion of the container, the neck portion having been rotated 90° from the position of FIG. 2 in the direction of right to left.

There is illustrated in FIG. 1 the combination in accordance with the invention of a neck portion 11 of a container and a cap or cover 14 applied thereto. The thread 12 on the container neck is continuous, and includes a bottom stop portion 15 which extends parallel to the longitudinal axis of the container 10. This stop 15 has an axial stop surface **15*a* which is adapted to coact with stop surface 15*b* of the mating divided thread 13 of the cap or closure 14. The thread 12 also has an upper stop surface 16 which cooperates with stop 16*a* on the internal thread 13 of the closure 14. While the stop surfaces 15*a* and 16 of the thread 12 and the stop surfaces 15*b* and 16*a* of the internal thread 13 are shown as being axially aligned, they may also be non-aligned. However, the axial alignment, particularly a 360° rotational spacing, makes for a better and tighter seal because it offers the most efficient torque resistance against an excessively large rotational force which may be applied. The neck portion 11 includes a transverse annular bead 11*a*, the axial distance "a" between the top of the transverse bead 11*a* and the bottom of the flank of the thread cross-section at its lowest point is slightly larger than the distance "b" which is the width of the cross-section of the threads 13 in the closure, so that when this mating thread 13 is turned home against the stop surface 15*a* a clamping action is effected by the transfer bead 11*a* and the lower end of the thread 12** which increases further the torque resistance.

As can be noted by those skilled in the art the threads 12 and 13 of the illustrative embodiment are of the "acme" or "buttress" thread type. It has been found that those types of threads work best with the closures of this invention.

Moreover, the pitch angle of the threads is less than 8°. By so limiting the pitch angle, the optimum amount of friction is obtained for turning the closure home, thereby obtaining a good seal while at the same time enabling the user to easily seal and unscrew the closure top.

The aforedescribed embodiment as well as all the other embodiments which will be described hereinafter are preferably made by injection molding techniques. While many types of plastic materials, suitable for mass-production by injection molding techniques, may be used as material for the closure of this invention, the most advantageous has been found to be a strong resilient plastic, particularly polypropylene. By using the aforedescribed thread construction, pitch angle and material, a self-locking effect is achieved.

FIG. 1 illustrates, the coaction between the stop surfaces 15*a* and 15*b*. All of the above described structure is disclosed in parent application Ser. No. 615,937, the contents of which are incorporated herein by reference thereto. All of FIGS. 2 to 5, inclusive, herein illustrate the new anti-rotational stop which this invention adds to the double-stopped bottle neck disclosed and claimed in parent application Ser. No. 615,937 now U.S. Pat. No. 4,519,518.

The anti-rotational stop of the invention is in the nature of a ramp disposed between the last turn of the thread 12 on the bottle neck and the transverse annular bead 11*a* thereon as shown in the drawings. The ramp starts at zero radial height at the location 18 which is spaced 180° counterclockwise from stop surface 15*a* in FIGS. 4 and 5 and gradually increases in radial height through an angle of 90° in a clockwise direction in FIGS. 4 and 5 with respect to the container neck. The ramp is generally designated 17, its end face of greatest radial height being designated 17*a*. The vertical geometrical elements making up the radially outer surface of the ramp 17 are preferably straight and parallel to the axis of the container neck. The end face 17*a* of ramp 17 is displaced 90° behind (counterclockwise of) the stop surface 15*a* on the container neck, as shown in FIGS. 4 and 5, and as evident from FIGS. 1, 2, and 3, as well.

The thread 12 on the container neck is continuous, but the thread 13 on the inner wall of the closure 14 is divided. This is particularly well shown in FIG. 4 wherein the thread 13 is shown as being made up of two diametrically opposed symmetrically disposed portions which are 90° in length and are separated by the gaps 20, gaps 20 also being 90° in length.

Figure 4:
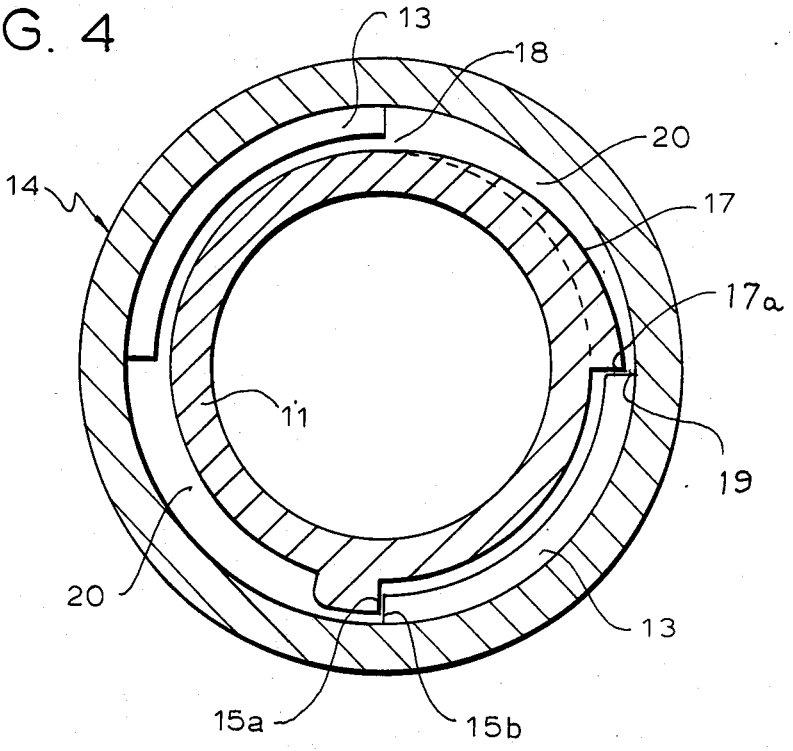
FIG. 4 is a view in transverse section through the container neck with the closure mounted thereon in its final position.
Figure 5:
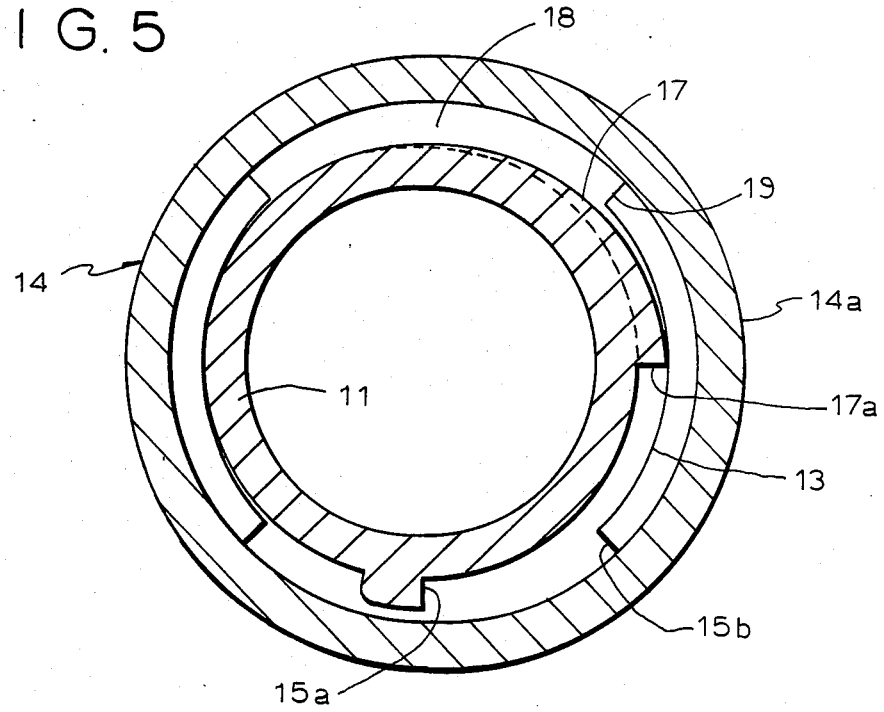
FIG. 5 is a view similar to FIG. 4 but with the closure having been turned 45° counter-clockwise with respect to the container neck relative to its position in FIG. 4.

In FIGS. 1 and 4, the closure is shown fully applied to the bottle neck, the stop surfaces 15*a* and 15*b* being in contact. The closure 14 is made of resilient plastic material such as polypropylene, and thus as the closure 14 is approaching its final position, (FIG. 4 wherein the stops 15*a* and 15*b* are in engagement), but with the stops 15*a* and 15*b* not yet in contact, the leading end 15*b* of a land of thread 13 rides up on the ramp 17 and causes the closure 14 locally to bulge as indicated in a somewhat exaggerated manner at 14*a* in FIG. 5. This action requires the clockwise (FIGS. 4 and 5) turning of the closure 14 with respect to the container neck with an increasing torque until stop surfaces 15*a* and 15*b* are in engagement. Because of the interlock between the trailing end 19 of closure thread 13 and the end face 17*a* of ramp 17, the closure is effectively held in its finally closed position. This locking action between the container neck and the closure requires a higher removal torque during the first 90° of relative counterclockwise rotation of the container and closure; following this, normal removal torque between the container neck and closure will be present. Upon removal of the land of thread 13 from the ramp 17, the side wall of the closure 14 resumes its original, unstressed circular cylincrical shape.

The locking between the container neck and the closure produced by the anti-rotational stop of the present invention is of value since it insures that the stop members 15*a* and 15*b*, once brought into engagement, will remain so despite shaking of the container as during its transportation or by reason of the fact that the contents of the bottle may be oily in character so that the closure would otherwise tend to unscrew by itself from the bottle neck.

Thus, when packaging lotions and cosmetics, ingredients with lubricants and other materials like isopropyl myristate can coat the sealing surfaces and threads, and result in the loss by the closure of at least some of its back-off torque. In some instances, this can result in the unscrewing of the closure by itself. The anti-rotational stop of the present invention effectively deals with and overcomes such self-unscrewing tendency of the prior closure to which this invention has been described as being applied.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. In a container closure assembly comprising a threaded neck portion on said container which includes at least one external helical thread having a lower non-helical stop surface, a closure having a sidewall with a divided internal mating helical thread having a lower non-helical stop surface, said lower stop surfaces of said external and internal helical threads contacting each other to stop the threading rotation of said closure on said neck portion at a predetermined, fully closed position of the closure, the improvement which comprises an anti-rotational stop between the container neck and the closure, said stop comprising a helically disposed ramp on the container neck angularly in front of said lower stop surface of the container neck relative to the threading on rotation, said ramp being of increasing radial height in the direction in which the closure is screwed onto the container neck and having a rear end of minimum radial height and a forward end of maximum radial height length, said ramp being engaged by the forward end of a land of a portion of the divided thread on the closure during the threading on rotation and the rear end of a land of said portion of the divided thread moving slightly past said forward end of said ramp as the closure is screwed toward its final, fully closed position, whereby said divided thread is then disposed between said lower stop surface and the forward end of said ramp.

2. The container enclosure assembly as set forth in claim 1, wherein said external helical thread on the container neck is continuous.

3. The container enclosure assembly as set forth in claim 1, wherein at least one of the container neck and the closure side wall is made of resilient material which elastically yields under the increasing force between the ramp and the end of the land of the divided thread on the closure side wall as the closure is progressively screwed towards it final, fully closed position.

4. The container enclosure assembly as set forth in claim 3, wherein the closure side wall is made of resiliently yieldably plastic material.

* * * * *